United States Patent [19]

Lang

[11] 4,082,280

[45] Apr. 4, 1978

[54] THREE-DIMENSIONAL, LAYERED, SELF SEALING TARGET

[76] Inventor: Otis C. Lang, R.D. 1, Box 221, Pittston, Pa. 18643

[21] Appl. No.: 598,044

[22] Filed: Dec. 3, 1975

[51] Int. Cl.[2] ..... F41J 3/00

[52] U.S. Cl. ..... 273/102 B

[58] Field of Search ..... 273/102 R, 102 B, 102.4, 273/105.6, DIG. 4; D34/5 PP

[56] References Cited

U.S. PATENT DOCUMENTS

| | | | |
|---|---|---|---|
| 747,710 | 12/1903 | Hollifield | 273/102.4 X |
| 2,069,822 | 2/1937 | Douglas | 273/102.4 |
| 2,812,947 | 11/1957 | Fatzinger | 273/102 B |
| 2,818,258 | 12/1957 | Stern | 273/102 B |
| 3,163,418 | 12/1964 | Myers | 273/102 B |
| 3,367,660 | 2/1968 | DiMaggio | 273/102 B |
| 3,476,390 | 11/1969 | Roloff et al. | 273/102.4 X |
| 3,516,670 | 6/1970 | D'Agostino et al. | 273/DIG. 4 |
| 3,682,478 | 8/1972 | Knight | 273/DIG. 4 |
| 3,685,830 | 8/1972 | Holm | 273/102 R |
| 3,844,561 | 10/1974 | Renault | 273/105.2 |
| 3,917,270 | 11/1975 | Gothard | 273/105.2 |

FOREIGN PATENT DOCUMENTS

| | | | |
|---|---|---|---|
| 696,139 | 8/1953 | United Kingdom | 273/102 B |
| 1,208,442 | 10/1970 | United Kingdom | 273/DIG. 4 |

*Primary Examiner*—Richard C. Pinkham
*Assistant Examiner*—Vance Y. Hum
*Attorney, Agent, or Firm*—Anthony J. Dixon

[57] ABSTRACT

A self-sealing archery target intended to be supported on a bale of hay or the like, comprising a paper mache sheet mold arranged in the three-dimensional size and shape of an animal, said molding covered with a plurality of latex rubber layers tinted to emulate the coloring of an animal.

1 Claim, 4 Drawing Figures

Figure 3:
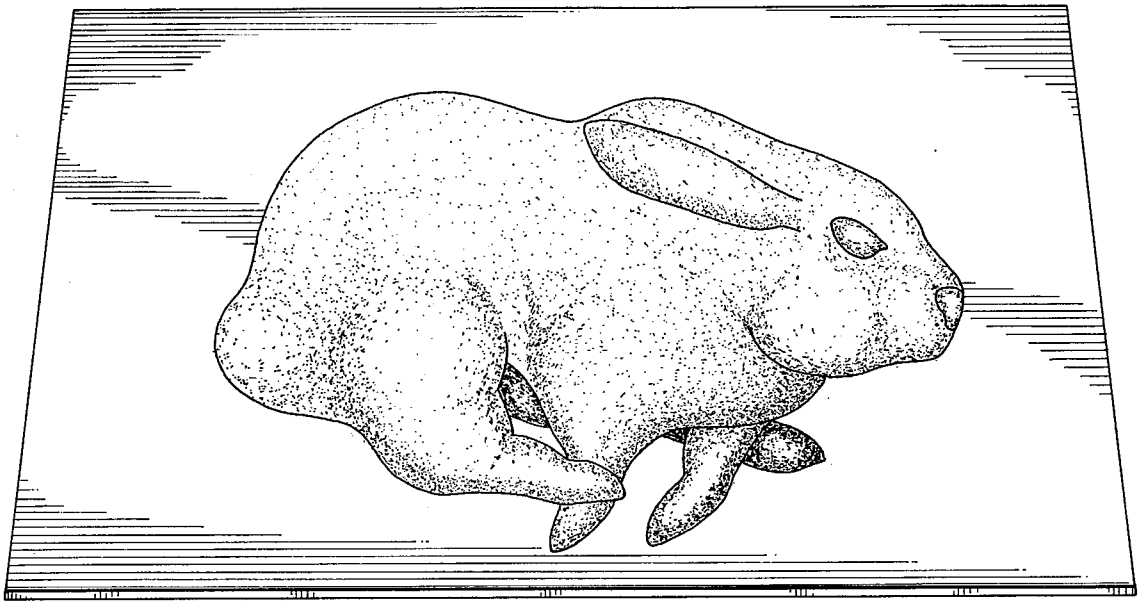

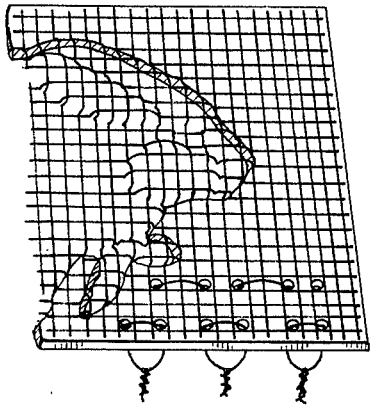
Fig. 2
Fig. 1
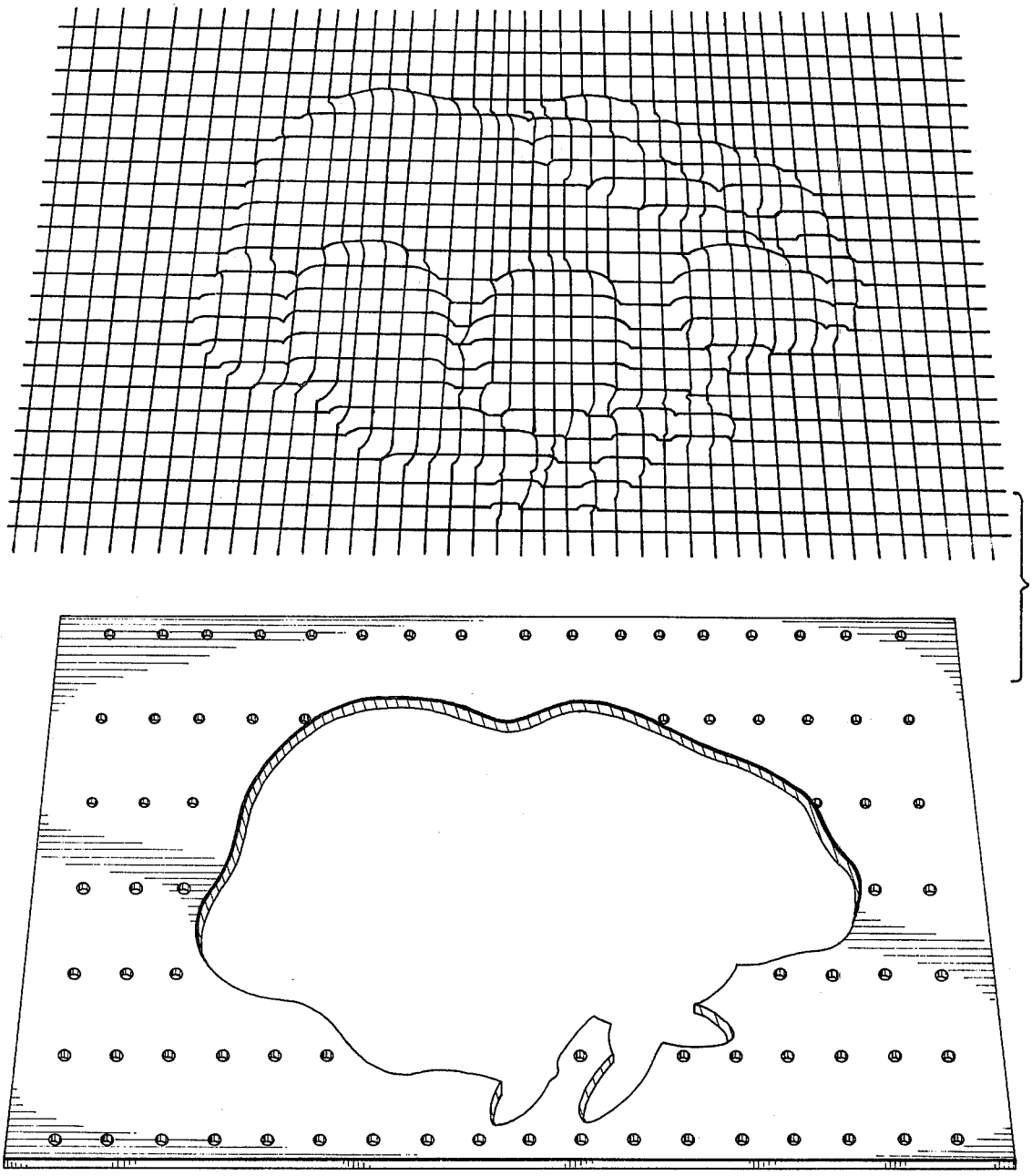

THREE-DIMENSIONAL, LAYERED, SELF SEALING TARGET

BACKGROUND OF THE INVENTION

1. Field of the Invention

This invention relates to archery targets, particularly to archery targets which are self-sealing and emulate animals found in the wild and likely to be hunted by one utilizing the target for practice. More particularly the invention relates to a three-dimensional self-sealing archery target for use on a back-stop such as a bale of hay.

2. Backround of the Invention

It has long been the practice in the prior art to use paper throw away targets for the practice of archery. Improvements such as paper mache dipictions of animals in two-dimensions are also known. However, there has long been a need for a reusable self-sealing archery target which depicts an animal in three-dimensional fashion.

SUMMARY OF THE INVENTION

A self-sealing archery target has now been found which comprises:

a. a paper mache sheet molding constructed and arranged in three-dimensional high relief in the size and shape of an animal, and b. a plurality of layers of latex rubber applied to said paper mache molding of sufficient thickness to substentially re-seal an opening formed by an arrow shaft propelled there through. The outermost of said latex layers includs concentrated tint coloring emulating the coloring of an animal.

This target is attachable to a backstop such as a bale of hay.

A more complete understanding can be had by reading the following description of the preferred embodiment of the invention and the process of constructing same along with referral to the drawings.

DESCRIPTION OF THE DRAWINGS AND THE PREFERRED EMBODIMENT

The invention is depicted in the drawings as follows:

FIG. 1. View of the wire mold and the aluminum support.

FIG. 2. Fragmentary composite view of FIG. 1.

FIG. 3. Clay mold.

Figure 4:
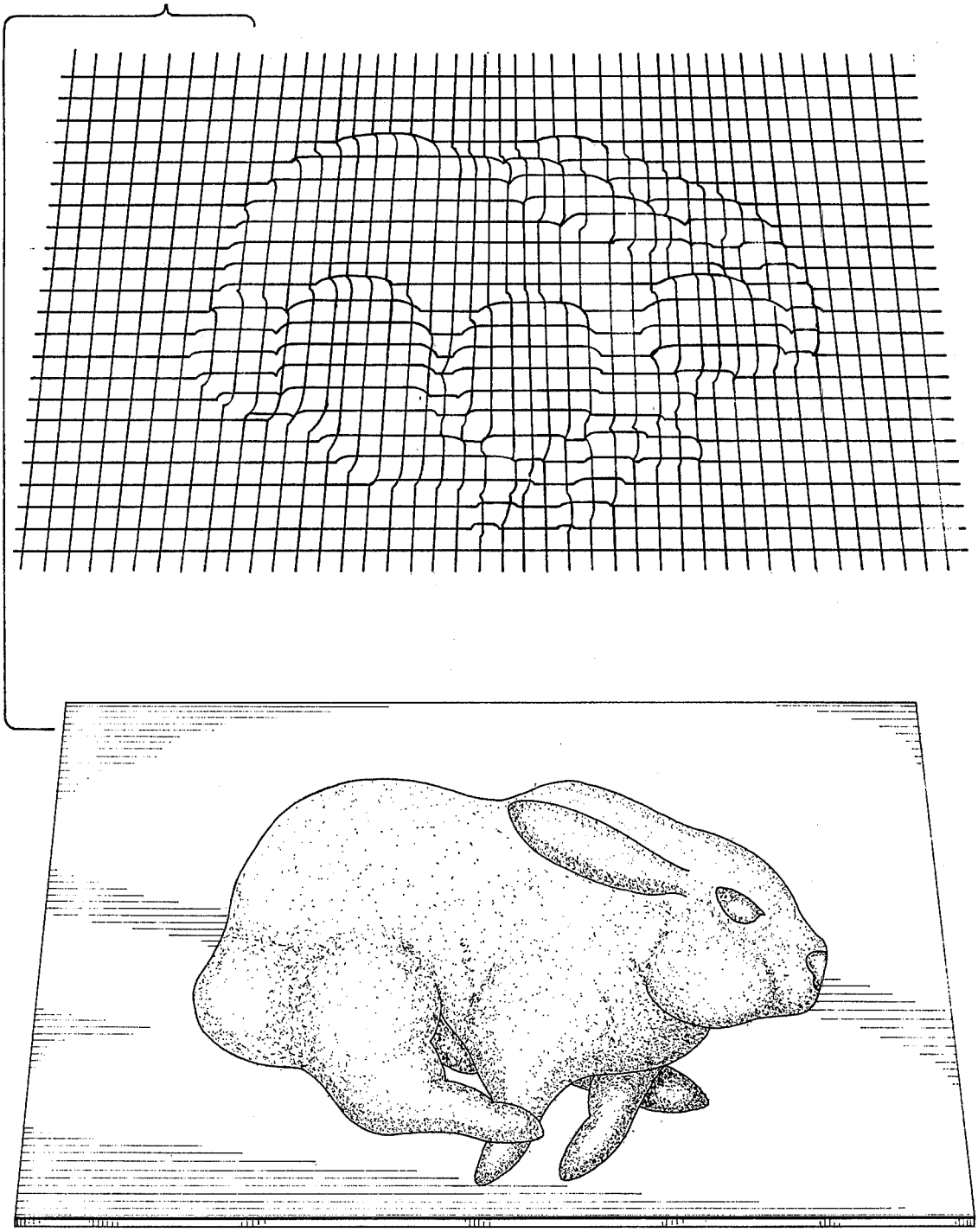

FIG. 4. Wire screen and clay mold.

To provide the archer with a life-like realistic animal target which is self-sealing and therefore reusable, the maker must first provide a drawing of the animal to be featured in the target showing the pose desired.

A copy of this drawing is then used for a base upon which molding clay of a commercially available variety is formed, molded and shaped to conform to the original drawing. Essentially, a three-dimensional cross section of the animal is formed, i.e. the front half of the pose.

After said clay is molded, it is dried by conventional techniques such as air drying and glazed with ceramic glaze compounds. After a second drying period, that is upon hardening of the glaze, the mold is completed as set forth in FIG. 3.

The maker next covers the mold with malleable, conformable wire screen such as copperwire screen. The size for an animal such as a rabbit would ordinarly be 14 × 17.

The screen is forced over the clay mold with an instrument that is rounded at the end, to prevent tearing the screen wire. The maker here must conform the wire mold as close as possible to the clay so that the details of the animal are reflected in the wire configuration. FIG. 4 shows this step completed. The maker now can remove the wire screen which has taken the shape of the desired animal.

Next an aluminum support is constructed in the style of a stencil of the cross section of the wire mold, (See FIG. 1). Holes along the outer periphery of the aluminum support are provided. The wire support is attached there to by attaching the excess of the mold which is flat to the aluminum support lying in the same plane. The connection is fixed by fastening with wire or similar fastening means.

Paper mache is applied to the mold as follows:

Ordinary newspaper is torn into small strips and blended with water to form a mache-pulp. A mixture of one-two paper to water by volume has been found effective; however other blends concocted by one skilled in the art may achieve like results and are still within the scope of the invention. The inside contour is coated with oil or vaseline or the like to prevent sticking and the paper mache is applied thereto to a thickness of a least about one-eighth inch.

The mold is dried by air drying or in an oven. A time period of 2 hours at 300° F is suggested but varying times and temperatures through reasonable experimentation will achieve similar results.

When dry, the mache form is removed from the wire mold and trimmed around the edges. The mache is then covered with latex rubber as is commercially available, said rubber applied with a brush and allowed to dry. A second coat, third or the tinting is used in the fourth coat. This tinting can be combined with the fourth coat, and four coats are recommended to insure proper sealing. The tinting is done by using a concentrated tint color as is also commercially available and used for coloring latex paints. Proportions of 2 to 1 tint to latex are suggested; however, varying proportions can be reasonable determined by experimenting by one skilled in the art and can also achieve the same results and are within the scopeof the present invention. Stencils can be used for various proportions of the figure and an air brush is recommended for this type of application.

I claim as my invention:

1. A resealable archery target attachable to a bale of hay comprising a paper mache sheet molding constructed and arranged in three-dimensional high relief in the size and shape of an animal; and a plurality of layers of latex rubber applied to said paper mache molding, of sufficient thickness to substantially re-seal an opening formed by an arrow shaft propelled there through, the outermost of said latex layers including concentrated tint coloring emulating the coloring of an animal.

* * * * *